US005842700A

United States Patent [19]

Fang et al.

[11] Patent Number: 5,842,700

[45] Date of Patent: Dec. 1, 1998

[54] COMPOSITE ROCK BIT SEAL

[75] Inventors: Zhigang Fang; Sujian Huang; Chris E. Cawthorne, all of Woodlands; Brian A. James, Houston; G. Steven Kyker, Big Sandy; Robert Denton, Pearland, all of Tex.

[73] Assignee: Smith International, Inc., Houston, Tex.

[21] Appl. No.: 727,001

[22] Filed: Oct. 8, 1996

[51] Int. Cl.[6] ..... F16J 15/34

[52] U.S. Cl. ..... 277/336; 277/407; 277/910; 277/944

[58] Field of Search ..... 277/336, 407, 277/440, 441, 500, 584, 910, 936, 944; 175/371

[56] References Cited

U.S. PATENT DOCUMENTS

| | | | |
|---|---|---|---|
| 2,360,735 | 10/1944 | Smith | 277/177 |
| 2,926,976 | 3/1960 | Bowerman et al. | 277/188 R |
| 2,953,398 | 9/1960 | Haugen et al. | 277/227 |
| 3,049,385 | 8/1962 | Smith | 277/188 R |
| 3,778,654 | 12/1973 | Hueschen et al. | 313/60 |
| 3,918,726 | 11/1975 | Kramer | 277/227 |
| 4,194,748 | 3/1980 | Forch et al. . | |
| 4,223,896 | 9/1980 | Strom | 277/206 R |
| 4,280,709 | 7/1981 | Heikes, Jr. et al. | 277/227 |
| 4,557,609 | 12/1985 | Moren | 394/94 |
| 4,776,599 | 10/1988 | Vezirian | 277/95 |
| 5,323,863 | 6/1994 | Denton | 277/227 |
| 5,362,073 | 11/1994 | Upton et al. | 277/92 |
| 5,509,670 | 4/1996 | Wheeler | 277/188 R |

*Primary Examiner*—Anthony Knight
*Assistant Examiner*—John L. Beres
*Attorney, Agent, or Firm*—Christie, Parker & Hale, LLP

[57] ABSTRACT

A high performance rock bit journal seal is formed from a composite material comprising an elastomeric material and a nonelastomeric polymeric material. The polymeric material is preferably in the form of fibers woven into a sheet. The elastomeric material includes at least one lubricant additive. The composite seal material comprises a number of repeating sheets of polymeric fabric that are bonded together with the elastomeric material. In one embodiment, the seal includes a body formed entirely from the composite material, in which case both the static and dynamic seal surfaces are the same. In another embodiment, the seal includes a first body portion formed from the composite material, and a remaining body portion formed from a noncomposite elastomeric seal material. Seals formed from the composite seal material display enhanced wear resistance, reduced coefficient of friction, and improved high-temperature stability and endurance when compared to noncomposite seal materials, thereby both extending the useful life of seals formed therefrom formed and of rock bits that employ such seals.

24 Claims, 2 Drawing Sheets

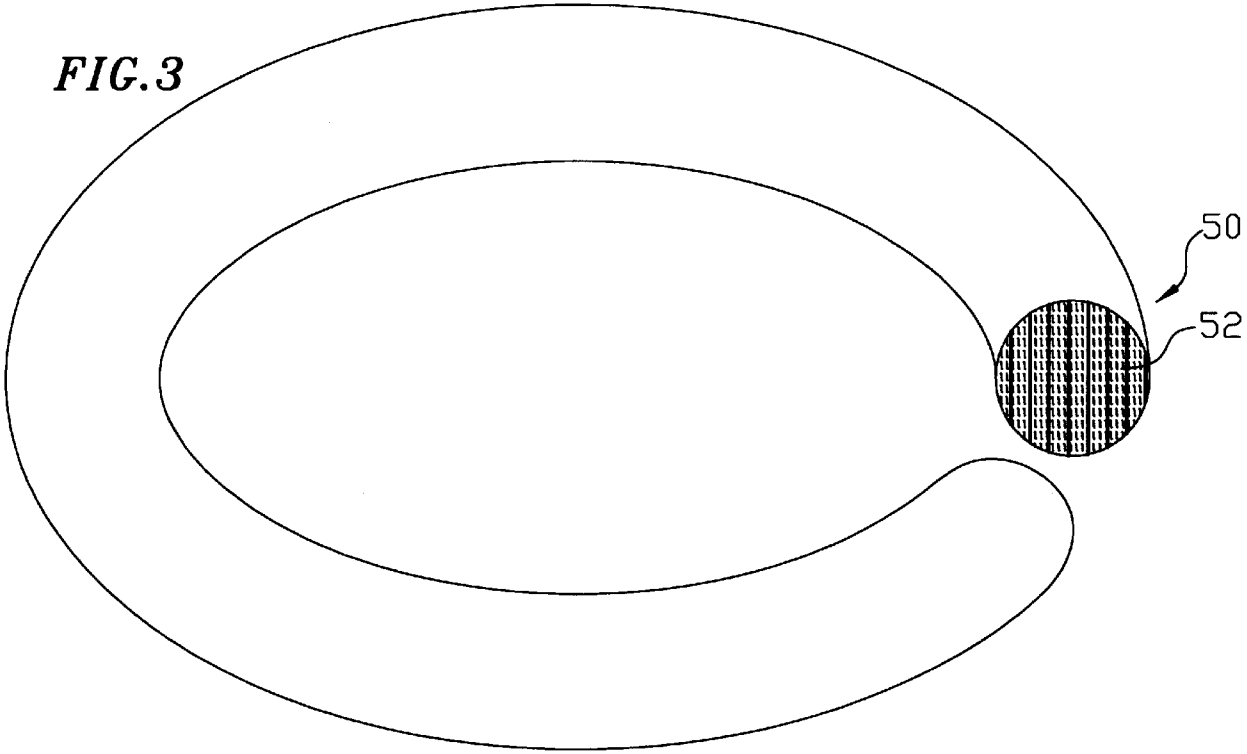
FIG.3
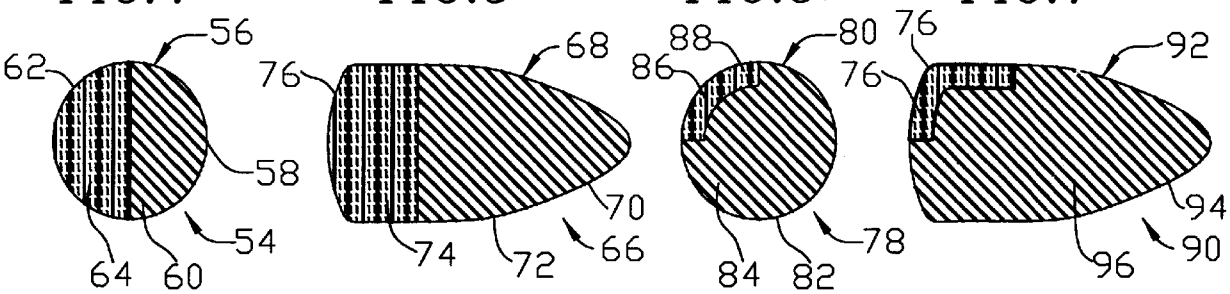
FIG.4
FIG.5
FIG.6
FIG.7

COMPOSITE ROCK BIT SEAL

FIELD OF THE INVENTION

This invention relates to seals used for retaining the lubricant around a bearing journal in a rock, mining, or drill bit used for drilling oil wells or the like. More particularly, this invention relates to seals constructed from a composite material that provide an improved degree of temperature and friction resistance, thereby enhancing the service life of both the seal and bit.

BACKGROUND OF THE INVENTION

Rock bits are employed for drilling wells, blast holes, or the like in subterranean formations for oil, gas, geothermal steam, minerals, and the like. Such drill bits have a body connected to a drill string and a plurality, typically three, of hollow cutter cones mounted on the body for drilling rock formations. The cutter cones are mounted on steel journals or pins integral with the bit body at its lower end. In use, the drill string and/or the bit body are rotated in the bore hole, and each cone is caused to rotate on its respective journal as the cone contacts the bottom of the bore hole being drilled. As such a rock bit is used for drilling deep wells, tough formations, high pressures and temperatures are encountered.

When a drill bit wears out or fails as a bore hole is being drilled, it is necessary to withdraw the drill string for replacing the bit. The amount of time required to make a round trip for replacing a bit is essentially lost from drilling operations. This time can become a significant portion of the total time for completing a well, particularly as the well depths become great. It is therefore quite desirable to maximize the service life of a drill bit in a rock formation. Prolonging the time of drilling minimizes the time lost in "round tripping" the drill string for replacing the bits. Replacement of a drill bit can be required for a number of reasons, including wearing out or breakage of the structure contacting the rock formation.

One cause of rock bit failure is due to severe wear that occurs on journal bearings on which the cutter cones are mounted. These bearings can be friction or roller type bearings and can be subject to high pressure drilling loads, high hydrostatic pressures in the hole being drilled, and high temperatures due to drilling, as well as elevated temperatures in the formation being drilled. The journal bearings are lubricated with grease adapted to such severe conditions. The grease is retained within the rock bit, to lubricate the journal bearings, by a seal. The seal is typically in the form of a ring and includes a dynamic seal surface, that is placed in rotating contact against a journal surface, and a static seal surface, that is placed in contact against a stationary cone surface. The seal must endure a range of different temperature and pressure conditions at the dynamic and static seal surfaces during the operation of the rock bit to prevent the grease from escaping and/or contaminants from entering and, thereby ensure that the journal bearings remain sufficiently lubricated.

Journal seals known in the art are typically provided in the form of an O-ring type seal made from exclusively rubber or elastomeric materials. While journal seals formed from such rubber or elastomeric materials display excellent sealing properties of elasticity and conformity to mating surfaces, they display poor tribiological properties, low wear resistance, a high coefficient of friction, and a low degree of high-temperature endurance and stability during operating conditions. Accordingly, the service life of rock bits equipped with such seals is defined by the limited ability of the elastomeric seal material to withstand the different temperature and pressure conditions at each dynamic and static seal surface.

U. S. Pat. No. 3,778,654 issued to Mandley discloses a multiple hardness O-ring comprising a seal body formed from nitrile rubber, and a hardened exterior skin surrounding the body that is formed by surface curing the exterior surface of the nitrile rubber. Although the patent teaches that the O-ring seal constructed in this manner displays improved hardness and abrasion resistance, the act of hardening the entire outside surface of the seal body causes the seal to lose compressibility and other related properties that are important to the seal's performance at the static seal surface.

U.S. Pat. No. 4,557,609 issued to Moren discloses a drill bit seal having a dynamic and static seal surface formed from different materials. The dynamic seal surface is formed from a relatively low friction material comprising Teflon that is deposited onto a inside diameter surface of the seal. The static seal surface is formed from the same material that is used to form the seal body. The Teflon surfaces acts to improve the wear resistance of the seal at the dynamic seal surface. However, the use of Teflon on the dynamic seal surface only provides a temporary improvement in wear resistance because it eventually wears away to uncover the relatively less wear resistant seal body.

U.S. Pat. No. 5,362,073 issued to Upton et al. discloses a composite rock bit seal comprising a dynamic seal surface, formed from a single type of elastomeric material, and has inner and outer static seal surfaces that are each formed from different elastomeric materials. The elastomeric materials used to form the static seal surface are less wear resistant than the elastomeric materials forming the dynamic seal surface. The materials forming the dynamic and static seal surfaces are bonded together by cross-linking to form the seal body. Although the seal provides a degree of improved wear resistance at the dynamic seal surface, it is still limited to what an elastomer can offer in terms of wear resistance, therefore the dynamic surface geometry will still be the point of failure of the seal.

It is, therefore, desired that a journal seal be constructed in a manner that displays sealing properties that are equal to or better than those of seals formed exclusively from elastomeric materials. It is also desired that the seal construction display improved tribiological properties, improved wear resistance, a reduced coefficient of friction, and improved high-temperature endurance and stability when compared to conventional journal seals formed exclusively from elastomeric materials.

SUMMARY OF THE INVENTION

There is, therefore, provided in practice of this invention, high performance journal seals, at least a portion of which or the entire seal being formed from composite materials comprising a nonelastomeric polymeric material, and an elastomeric material bonded to the polymeric material. The non-elastomeric polymeric material is preferably in the form of fibers woven to form a sheet of fabric. The elastomeric material may include at least one lubricant additive. In a preferred embodiment, the seal is formed from a composite material comprising a number of repeating sheets of polymeric fabric bonded together with the elastomeric material.

In one embodiment, the seal includes a body that is formed entirely from the composite material, in which case both static and dynamic seal surfaces are formed from the same material. In another embodiment, the seal includes a first body portion formed from the composite material, and a remaining second body portion formed from a noncomposite elastomeric seal material. In such embodiment, it is preferred that the static surface of the seal be formed from the noncomposite material, and the dynamic surface of the seal be formed from the composite seal material to, thereby, enhance seal life at the dynamic surface. It is desired that the elastomeric material used to form the noncomposite and composite seal material be the same or chemically compatible with each other to facilitate cross linking between the static and dynamic seal surfaces to form a good bond therebetween.

Rock bit seals formed from the composite material of this invention display enhanced wear resistance, reduced coefficient of friction, and improved high-temperature stability and endurance when compared to noncomposite seal materials, thereby both extending the useful life of seals formed therefrom formed and of rock bits that employ such seals.

BRIEF DESCRIPTION OF THE DRAWINGS

These and other features and advantages of the present invention will become appreciated as the same becomes better understood with reference to the specification, claims and drawings wherein:

FIG. 3 is a cross-sectional view of a first embodiment of a journal seal constructed according to the principles of this invention;

FIG. 4 is a cross-sectional view of a second embodiment of a journal seal constructed according to the principles of this invention;

FIG. 5 is a cross-sectional view of a third embodiment of a journal seal constructed according to the principles of this invention;

FIG. 6 is a cross-sectional view of an alternative second embodiment of a journal seal constructed according to the principles of this invention; and FIG. 7 is a cross-sectional view of an alternative third embodiment of a journal seal constructed according to the principles of this invention.

DETAILED DESCRIPTION

Figure 1:
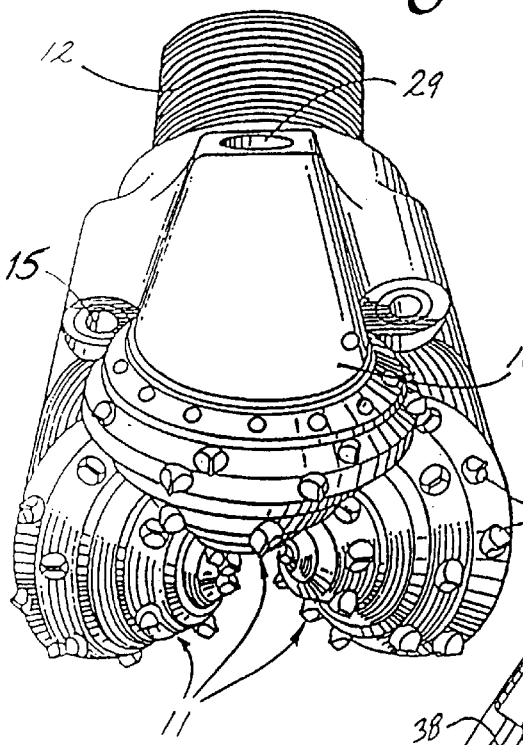
FIG. 1 is a semi-schematic perspective of a rock bit containing a journal seal constructed according to the principles of this invention.

A rock bit employing a journal seal constructed according to principles of this invention comprises a body 10 having three cutter cones 11 mounted on its lower end, as shown in FIG. 1. A threaded pin 12 is at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling fluid into the space around the cutter cones for cooling and carrying away formation chips drilled by the bit.

Journal seals constructed according to principles of this invention can be embodied: (1) in the shape of an O-ring, comprising a circular inside and outside diameter, and having a circular cross section; (2) having a radial high-aspect ratio cross sectional geometry (i.e., the cross sectional radial width is greater than an axial width); or (3) having any other type of symmetrical or asymmetrical cross-sectional geometry. A key feature of journal seals of this invention is that they are constructed from a composite material comprising both non-elastomeric polymeric material and elastomeric materials.

Figure 2:
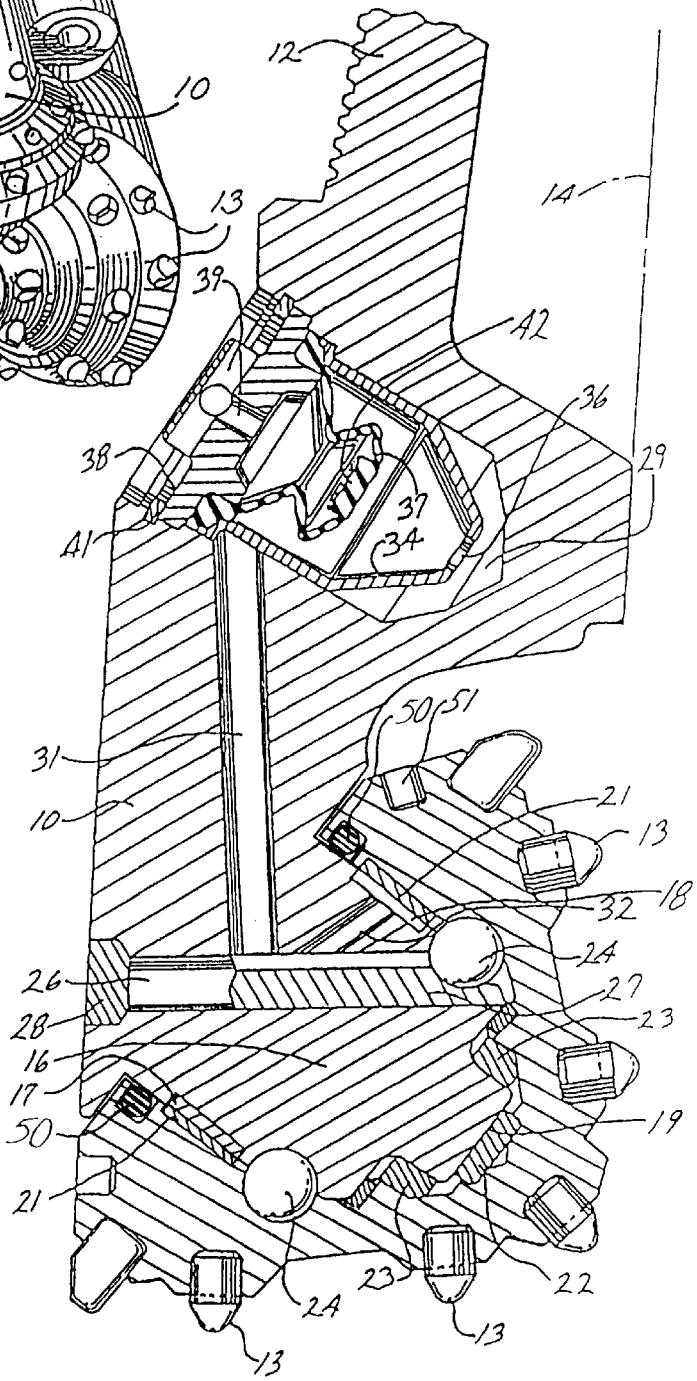
FIG. 2 is a partial cross-sectional view of the rock bit comprising a journal seal constructed according to the principles of this invention.

FIG. 2 is a fragmentary, longitudinal cross-section of the rock bit, extending radially from the rotational axis 14 of the rock bit through one of the three legs on which the cutter cones 11 are mounted. Each leg includes a journal pin extending downwardly and radially, inwardly on the rock bit body. The journal pin includes a cylindrical bearing surface having a hard metal insert 17 on a lower portion of the journal pin. The hard metal insert is typically a cobalt or iron-based alloy welded in place in a groove on the journal leg and having a substantially greater hardness that the steel forming the journal pin and rock bit body.

An open groove 18 is provided on the upper portion of the journal pin. Such a groove may, for example, extend around 60 percent or so of the circumference of the journal pin, and the hard metal insert 17 can extend around the remaining 40 percent or so. The journal pin also has a cylindrical nose 19 at its lower end.

Each cutter cone 11 is in the form of a hollow, generally-conical steel body having cemented tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin. Other types of bits, particularly for higher rotational speed applications, have roller bearings instead of the journal bearings illustrated herein. It is to be understood that a journal seal constructed according to principles of this invention may be used with rock bits comprising either roller bearings or conventional journal bearings.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place. The bearing surfaces between the journal pin and the cone are lubricated by a grease. Preferably, the interior of the rock bit is evacuated, and grease is introduced through a fill passage (not shown). The grease thus fills the regions adjacent the bearing surfaces plus various passages and a grease reservoir, and air is essentially excluded from the interior of the rock bit. The grease reservoir comprises a cavity 29 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal in the form of a journal seal 50 between the cone and journal pin. In an alternative embodiment, the journal seal is in a slightly ramped or V-shaped groove.

A pressure compensation subassembly is included in the grease reservoir 29. The subassembly comprises a metal cup 34 with an opening 36 at its inner end. A flexible rubber bellows 37 extends into the cup from its outer end. The bellows is held into place by a cap 38 with a vent passage 39. The pressure compensation subassembly is held in the grease reservoir by a snap ring 41.

When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the journal seal 50 and permit drilling fluid or the like to enter the bearings. Such material is abrasive and can quickly damage the bearings. Conversely, if the grease volume should contract, the bellows can expand to prevent low pressures in the sealed grease system, which could cause flow of abrasive and/or corrosive substances past the O-ring seal.

The bellows has a boss 42 at its inner end which can seat against the cap 38 at one end of the displacement of the bellows for sealing the vent passage 39. The end of the bellows can also seat against the cup 34 at the other end of its stroke, thereby sealing the opening 36. If desired, a pressure relief check valve can also be provided in the grease reservoir for relieving over-pressures in the grease system that could damage the O-ring seal. Even with a pressure compensator, it is believed that occasional differential pressures may exist across the journal seal of up to 150 psi (550 kilopascals).

To maintain the desired properties of the journal seal at the pressure and temperature conditions that prevail in a rock bit, to inhibit "pumping" of the grease through the seal, and for a long useful life, it is important that the journal seal be resistant to crude gasoline and other chemical compositions found within oil wells, have a high heat and abrasion resistance, have low rubbing friction, and not be readily deformed under the pressure and temperature conditions in a well which could allow leakage of the grease from within the bit or drilling mud into the bit.

Journal seals conventionally employed in rock bits are shaped in the form of an O-ring and are formed from noncomposite materials comprising elastomeric or rubber materials, such as acrylonitrile polymers or acrylonitrile/butadiene copolymers. Other components sometimes used in the polymers include activators or accelerators for the curing, such as stearic acid, and agents that improve the heat resistance of the polymer, such as zinc oxide and curing agents.

Synthetic rubbers used to form such seals typically exhibit poor heat resistance and are known to become brittle when exposed to elevated operating temperatures after extended periods of time, i.e., display poor high-temperature endurance and stability. Such compounds are also known to have undesirably low tensile strength and high coefficients of friction, and are not well suited for use in forming journal seals because of the high operating temperatures and aggressive wear that is know to occur in rock bits. Additionally, journal seals formed exclusively from elastomeric or rubber materials have also been found to have poor tribiological properties, further contributing to accelerated seal degradation during use.

Journal seals, constructed according to principles of this invention, are formed from a composite material comprising nonelastomeric polymeric materials and elastomeric or rubber materials. Seals formed from such composite material offers key advantages when compared to seals formed from noncomposite materials, such as those formed exclusively from elastomeric materials, due to the high degree of high-temperature endurance and stability, wear resistance, and a reduced coefficient of friction afforded by the composite material.

It is to be understood that the polymeric material is nonelastomeric or "elastomer free" and that the terms polymeric material and nonelastomeric polymeric material shall be used interchangeably to mean the same thing. Nonelastomeric polymeric materials useful for forming the composite journal seal are preferably in the form of fibers and include those selected from the group consisting of polyester fiber, cotton fiber, aromatic polyamides (Aramids) such as those available under the Kevlar family of compounds, polybenzimidazole (PBI) fiber, poly m-phenylene isophthalamide fiber such as those available under the Nomex family of compounds, and mixtures or blends thereof. The fibers can either be used in their independent state, or may be combined into threads or woven into fabrics and used in the resulting state. Preferred nonelastomeric polymeric materials include those having a softening point higher than about 350° F., and having a tensile strength of greater than about 10 Kpsi. Other polymeric materials suitable for use in forming composite seals include those that display properties of high-temperature stability and endurance, wear resistance, and have a coefficient of friction similar to that of the polymeric material specifically mentioned above. If desired, glass fiber can be used to strengthen the polymeric fiber, in such case constituting the core for the polymeric fiber.

An exemplary nonelastomeric polymeric material is a polyester-cotton fabric having a density of approximately eight ounces per square yard. The polymeric material is provided in the form of a fabric sheet having a desired mesh size.

Suitable elastomeric materials useful for forming the seal construction include those selected from the group of fluoroelastomers including those available under the trade name Advanta manufactured by DuPont, carboxylated elastomers such as carboxylated nitriles, highly saturated nitrile (HSN) elastomers, nitrile-butadiene rubber (HBR), highly saturated nitrile-butadiene rubber (HNBR) and the like. Suitable elastomeric materials have a modulus of elasticity at 100 percent elongation of from about 500 to 2,000 psi (3 to 12 megapascals), a minimum tensile strength of from about 1,000 to 7,000 psi (6 to 42 megapascals), elongation of from 100 to 500 percent, die C tear strength of at least 100 lb/in. (1.8 kilogram/millimeter), durometer hardness Shore A in the range of from about 60 to 95, and a compression set after 70 hours at 100° C. of less than about 18 percent, and preferably less than about 16 percent. A preferred elastomeric material is a proprietary HSN manufactured by Smith International, Inc., under the product name HSN-8A.

Composite materials used to form seal constructions of this invention preferably comprise in the range of from 10 to 90 percent by volume polymeric material. A seal formed from a composite material comprising less than about 10 percent by volume of the polymeric material will not produce a desired degree of high-temperature stability and endurance, and wear resistance. A seal formed from a composite material comprising greater than about 90 percent by volume of the polymeric material will be too rigid and lack a desired degree of elasticity to act as a good seal material. A composite material comprising less than about 30 percent by volume of the elastomeric material will form a seal having a reduced degree of elasticity and poor compressibility. A composite material comprising greater than about 90 percent by volume of the elastomeric material will form a seal having an insufficient amount of the polymeric material to provide a desired degree of high-temperature stability and endurance, and wear resistance. A particularly preferred seal is formed from a composite material comprising approximately 50 percent by volume polymeric material.

The seal construction preferably includes one or more lubricant additives, dispersed uniformly through the elastomeric material, to further reduce wear and friction along the surface of the seal. Suitable lubricant additives include those selected from the group consisting of polytetrafluoroethylene (PTFE), hexagonal boron nitride (hBN), flake graphite, molybdenum disulfide ($MoS_2$) and other commonly known fluoropolymeric, dry or polymeric lubricants, and mixtures thereof. The lubricant additive is used to provide an added degree of low friction and wear resistance to the elastomeric component of the composite material that is placed in contact with a rotating surface. A preferred lubricant additive is hBN manufactured by Advanced Ceramics identified as Grade HCP, having an average particle size in the range of from about five to ten micrometers. hBN is a preferred lubricant additive because it provides a superior degree of lubrication when placed in contact with steel without producing harmful, e.g., abrasive, side effects to the journal or cone.

Journal seals constructed according to principles of this invention preferably comprise in the range of from about 5 to 20 percent by volume lubricant additive. A seal construction comprising less than about five percent by volume of the lubricant additive would contain less of the lubricant additive than was necessary to produce a desired decrease in surface friction and wear resistance of the elastomeric component. A seal construction comprising greater than 20 percent by volume of the lubricant additive is not desired because it could interfere with or adversely affect desired mechanical properties of the elastomer material. A particularly preferred seal construction comprises approximately ten percent by volume lubricant additive.

Composite journal seals are constructed, according to principles of this invention, by dissolving a desired quantity of the selected uncured (liquid) elastomeric material in a suitable solvent. Solvents useful for dissolving the elastomeric material include those organic solvents that are conventionally used to dissolve rubber or elastomeric materials.

A desired quantity of lubricant additive is added to the elastomer mixture. The desired nonelastomeric polymeric material is then added to the dissolved elastomeric material so that it is completely immersed in and saturated by the elastomeric material. In an exemplary embodiment, the polymeric material is in the form of a fabric sheet that is placed into contact with the elastomeric material so that the sheet is completely impregnated with the elastomeric material. Preferably, the polymeric fabric sheet is impregnated with the elastomeric material by a calendaring process where the fabric sheet is fed between two oppositely positioned rotating metal rolls that are brought together to squeeze the fabric. The rolls are configured to contain a bank of the elastomeric mixture, which is forced into the fabric weave under pressure. The metal rolls are also heated to soften the elastomeric material and, thereby improve its penetration into the fabric.

The total number of polymeric fabric sheets that are used, and that are impregnated or saturated with the elastomeric material, depends on the desired build thickness of the composite material portion of the seal. If one long fabric sheet is impregnated, the sheet is cut and stacked one on top of another to build a desired seal thickness. Alternatively, a number of shorter sheets can be impregnated, which are then stacked on top of one another. The exact number of sheets that are stacked to form a desired seal thickness depend on such factors as the type and thickness of the particular polymeric fabric that is used, as well as the particular seal construction. For example, in one embodiment, the seal can be constructed entirely from the composite seal material, in which case the desired thickness of composite material for the seal would be approximately the radial thickness of the seal itself. In another embodiment, however, the seal can be constructed having only a portion formed from the composite material, in which case the desired thickness of the composite material for the seal would be approximately the radial thickness of the designated composite portion.

In the case where the seal is formed entirely from the composite material, the impregnated fabric sheets are stacked to a desired seal radial thickness and are wound into a cylinder having an inside and outside diameter roughly equaling that of the final seal ring. The axial ends of the sheets are cut so that the seal ring has an axial thickness roughly equaling that of the final seal ring. The cut ends are sewn together to form a closed loop. The sewn sheets, now roughly in the form of the seal ring, are loaded into a compression mold and the mold is heated to simultaneously form the seal and cure or vulcanize the elastomeric mixture. Cross linking the elastomeric material during cure forms a seal construction made up of polymeric fabric that is strongly entrapped and bonded within the elastomeric medium.

In the case where only a portion of the seal, e.g., a dynamic seal surface along the inside diameter of the seal, is formed from the composite material, the polymeric sheets are stacked and wound to provide the approximate radial thickness of the desired dynamic real surface. The axial ends of the stacked sheets are cut to the approximate axial thickness of the seal ring and the cut ends are sewn to form a closed loop. The sewn sheets, now roughly in the form of the dynamic seal surface, are placed into a portion of the mold that forms the dynamic seal surface, i.e., about an inside diameter of the mold. Uncured elastomeric material is loaded into the remaining portion of the mold, e.g., between the stacked sheets and the outside diameter of the mold, and the mold is heated and pressurized to simultaneously form the seal and cure or vulcanize both the elastomeric mixture impregnating the fabric and the added elastomeric material. During the cure process, the elastomeric mixture in the polymeric fabric undergoes cross-linking reactions with itself to entrap the polymeric fabric within the elastomeric medium, and the added elastomeric material undergoes cross-linking reactions with itself.

It is desired that the elastomeric material that is added to form the noncomposite portion of the seal construction be the same as, or be chemically compatible with, the elastomeric mixture used to impregnate the polymeric fabric so that during the cure process the elastomeric mixture and elastomeric material undergo cross-linking reactions with each other to form a seal comprising both composite and noncomposite materials that are homogeneously bonded together.

The completed journal seal is placed into position in the rock bit with the static seal surface placed into contact with an adjacent cone surface, and with the dynamic seal surface placed adjacent a journal bearing surface.

Referring to FIG. 3, a first journal seal embodiment 50 constructed according to principles of this invention is formed exclusively from the composite seal material 52 comprising the polymeric fabric impregnated with the elastomeric material, and having the lubricant additive uniformly distributed within the elastomeric material. Although the seal illustrated in FIG. 3 is configured in the form of an O-ring, having a symmetric cross section comprising a cylindrical dynamic seal surface about an inside diameter, and a cylindrical static surface about an outside diameter, it is to be understood that seals constructed according to principles of this invention formed entirely from the composite material can configured differently than that illustrated, e.g., having a high aspect ratio, i.e., having an axial thickness that is less than its radial thickness, or having other symmetric or asymmetric cross-sectional geometries.

Referring to FIG. 4, a second seal embodiment 54 is formed having a portion of the seal body 56, comprising a static seal surface 58 along an outside diameter of the seal body, formed from an elastomeric material 60, and having another portion of the seal body 56, comprising a dynamic seal surface 62 along an inside diameter of the seal body, formed from the composite seal material 64 of this invention. An advantage of the second seal embodiment, formed from both composite and noncomposite materials, is that each seal surface can be tailored to provide properties of wear resistance, elasticity, friction resistance, high-temperature endurance and stability that are best suited to meet the operating conditions at the different interfacing rock bit locations. For example, using the composite material to form the dynamic seal surface provides properties of enhanced wear resistance, friction resistance, and high-temperature endurance and stability where it is needed most, i.e., adjacent the rotating surface of the journal bearing, and using the noncomposite elastomeric material to form the static seal surface provides the desired degree of deformation and friction needed to energize the seal and prevent the static seal surface from moving against an adjacent cone surface.

Although the second seal embodiment is illustrated having a dynamic seal surface formed from the composite material, it is understood that the composite material can be used to form any portion of the seal where increased properties of wear resistance, friction resistance and the like are desired. Additionally, it to be understood that although the second seal embodiment is illustrated configured in the form of an O-ring, other symmetrical and asymmetrical cross-sectional seal geometries are understood to be within the scope of this invention.

Referring to FIG. 5, a third seal embodiment 66 has a seal body 68 comprising a static seal surface 70 formed from an elastomeric material 72, a dynamic seal surface 74 formed from the composite material 76, and having an asymmetric cross-sectional seal geometry. Specifically, the third seal embodiment comprises a dynamic seal surface 74 that has a larger radius of curvature than that of the static seal surface 70 for purpose of optimizing operation of the seal at each adjacent rotating and stationary surface, respectively. This is but one example of a seal that is constructed having an asymmetric cross-sectional seal geometry and being constructed from both the composite material and a noncomposite material. As discussed above, it is desired that the elastomeric material that is used to form the static seal surface be the same as or be compatible with the elastomeric material selected to form the composite material.

Referring to FIG. 6, an alternative second seal embodiment 78 has a seal body 80 comprising a static seal surface 82 formed from an elastomeric material 84, a dynamic seal surface 86 formed from the composite material 88 of this invention, and having a symmetric cross-sectional seal geometry. Unlike the second seal embodiment illustrated in FIG. 4, the alternative second seal embodiment comprises a dynamic seal surface 86 that is only partially formed from the composite material 88. Such alternative embodiment may be useful in particular applications where improved wear resistance, high-temperature endurance and stability, and a reduced coefficient of friction is desired only along a portion of the dynamic seal surface.

Referring to FIG. 7, an alternative third seal embodiment 90 has a seal body 92 comprising a static seal surface 94 formed from an elastomeric material 96, a dynamic seal surface 98 formed from the composite material 100 of this invention, and having an asymmetric cross-sectional seal geometry. Unlike the third seal embodiment illustrated in FIG. 5, the alternative third seal embodiment comprises a dynamic seal surface 98 that is only partially formed from the composite material 100. As previously discussed for the alternative second seal embodiment, such alternative third seal embodiment may be useful in particular applications where improved wear resistance, high-temperature endurance and stability, and a reduced coefficient of friction is desired only along a portion of the dynamic seal surface.

Although, limited embodiments of high performance journal seals for rock bits have been described and illustrated herein, many modifications and variations will be apparent to those skilled in the art. For example, although the journal seal has been described and illustrated for use with rock bits, it is to be understood that journal seals constructed according to principles of this invention can also be used with other bits, such as drill bits, mining bits or the like. Accordingly, it is to be understood that within the scope of the appended claims, that high performance journal seals according to principles of this invention may be embodied other than as specifically described herein.

What is claimed is:

1. A journal seal for use in a rotary cone rock bit comprising:

a substantially ring-shaped body having a dynamic rotary sealing surface along a first body portion, and a static sealing surface along a second body portion, wherein at least a portion of the dynamic rotary sealing surface is formed from a composite material comprising a fabric of nonelastomeric polymeric material that is bonded together with an elastomeric material, and wherein the fabric nonelastomeric polymeric material is positioned along a wear surface of the dynamic rotary seal surface in contact with a rotary rock bit surface.

2. A journal seal for use in a rotary cone rock bit comprising:

a seal body comprising a rotary sealing surface, wherein at least a portion of a rotary sealing surface is formed from a composite material comprising:

an elastomeric material; and a fabric formed from nonelastomeric polymeric material bonded with the elastomeric material, wherein the fabric is positioned along the rotary sealing surface to provide a wear surface for contact with a rotary rock bit surface.

3. A journal seal for use in a rotary cone rock bit comprising:

a ring-shaped body having a first sealing surface along one portion of the body, and having a second sealing surface along another portion of the body, wherein the second sealing surface is a rotary wear surface of the body and is at least partially formed from a composite material comprising a nonelastomeric polymeric fabric material bonded with an elastomeric material, wherein the fabric material is positioned along the rotary wear surface to provide resistance to wear from contact with a rock bit rotary surface.

4. The journal seal as recited in claim 3 wherein the first sealing surface is formed from an elastomeric material that is chemically compatible with the elastomeric material used to form the composite material.

5. The journal seal as recited in claim 3 wherein the elastomeric material comprises in the range of from about 5 to 20 percent by volume of the lubricant additives.

6. The journal seal as recited in claim 3 wherein the fabric material is formed from fibers selected from the group consisting of aromatic polyamines, polybenzimidazoles, poly m-phenylene isophthalamide, polyester, cottons, and combinations thereof.

7. A journal seal as recited in claim 6 wherein the composite material comprises at least one fabric layer bonded together with the elastomeric material.

8. A journal seal as recited in claim 3 wherein the composite comprises in the range of from about 10 to 90 percent by volume elastomeric material, and in the range of from about 10 to 90 percent by volume of the fabric material.

9. A rotary cone rock bit for drilling subterranean formations comprising;

a bit body including at least one journal pin extending from a leg portion of the bit and having a bearing surface;

a cutter cone rotatably mounted on the journal pin and including a lubricated bearing surface; and a journal seal interposed between the journal pin and cutter cone for forming a dynamic seal between the pin and cone to retain grease in the bearing comprising:

a seal body;

a first seal surface along one body face that is positioned against a sealing surface of one of the cone and journal pin; and a second seal surface along another body face that is positioned against a sealing surface of the other of the cone and journal pin, at least a portion of the seal surface forming the dynamic seal being formed from a composite material comprising a nonelastomeric polymeric fabric material that is bonded with an elastomeric material, the fabric material being positioned at a wear surface to provide resistance to wear from contact against the respective cone or pin sealing surface.

10. The rotary cone rock bit as recited in claim 9 wherein the fabric material is formed from fibers selected from the group consisting of aromatic polyamides, polybenzimidazoles, poly m-phenylene isophthalamide, polyester, cotton, and combinations thereof.

11. The rotary cone rock bit as recited in claim 9 wherein the composite material comprises repeating layers of the fabric that are bonded together with the elastomeric material.

12. The rotary cone rock bit as recited in claim 9 wherein the body is in the shape of a ring having a static sealing surface along a first body portion, and having a rotary wear surface along a second body portion.

13. The rotary cone rock bit as recited in claim 12 wherein the static sealing surface is formed from a noncomposite elastomeric material that is chemically compatible with the elastomeric material used to form the composite material.

14. A rotary cone rock bit as recited in claim 9 wherein the composite further comprises one or more lubricant additive distributed throughout the elastomeric material.

15. A rotary cone rock bit as recited in claim 14 wherein the lubricant additive is selected from the group consisting of polymeric materials, graphite, hexagonal boron nitride, molybdenum disulfide, and mixtures thereof.

16. A rotary cone rock bit for drilling subterranean formations comprising:

a bit body having at least one leg, the leg including a journal pin and having a first surface;

a cutter cone rotatably mounted on the leg and having a second sealing surface;

an annular seal ring interposed between the first sealing surface on the leg and the second sealing surface on the cone to form a dynamic seal between the cone and journal pin while the cutter cone is rotating, the seal ring comprising:

a body formed from an elastomeric material and having a first seal surface for forming a seal against one of the first or second sealing surfaces, and a second seal surface for forming a seal against the other of the first or second sealing surfaces, one of the seal ring first or second seal surfaces forming the dynamic seal, at least a portion of one of the first or second seal surface forming the dynamic seal being formed from a composite material comprising fabric formed from a nonelastomeric polymeric material bonded together with an elastomeric material that is chemically compatible with the elastomeric material used to form the seal body, the fabric being positioned along a wear surface to provide resistance to wear from contact against an adjacent rotary rock bit first or second sealing surface.

17. A rotary cone rock bit as recited in claim 16 wherein the elastomeric material used to form the composite material comprises a lubricant additive.

18. A journal seal as recited in claim 16 wherein the composite comprises in the range of from about 10 to 90 percent by volume elastomeric material, and in the range of from about 10 to 90 percent by volume of the polymeric material.

19. The rock bit as recited in claim 16 wherein a remaining portion of the seal not formed from the composite material is formed from an elastomeric material that is chemically compatible with the elastomeric material used to form the composite material.

20. The rock bit as recited in claim 16 wherein the one of the ring seal first or second sealing surfaces forming the dynamic seal is positioned along a seal ring inside diameter and has a cross sectional radius of curvature that is different than a cross sectional radius of curvature of the other of the ring seal first or second sealing surfaces that is formed along a seal ring outside diameter.

21. The rock bit as recited in claim 20 wherein the one of the first or second seal ring surfaces forming the dynamic seal has a cross sectional radius of curvature that is greater than a cross sectional radius of curvature of the other of the seal ring first or second sealing surface forming a static seal.

22. The rock bit as recited in claim 16 wherein the fabric is formed from fibers that are selected from the group consisting of aromatic polyamides, polybenzimidazoles, poly m-phenylene isophthalamide, polyester, cotton, and combinations thereof.

23. The rock bit as recited in claim 16 wherein the composite material comprises repeating layers of the fabric that are bonded together with the elastomeric material.

24. The rock bit as recited in claim 16 wherein the composite material comprises in the range of from about 10 to 90 percent by volume elastomeric material, and in the range of from about 10 to 90 percent by volume of the polymeric material.

* * * * *